US007098600B2

(12) United States Patent
Li et al.

(10) Patent No.: US 7,098,600 B2
(45) Date of Patent: Aug. 29, 2006

(54) CANDLE WITH INTERNAL ILLUMINATION

(75) Inventors: Xiao Feng Li, Shenzhen (CN); Stephen Shapiro, Arlington, MA (US); James V. Bonnema, Middleton, MA (US); Wen Der Wang, Wilmington, MA (US)

(73) Assignee: Market Reconnaissance Group, LLC, Needham, MA (US)

( * ) Notice: Subject to any disclaimer, the term of this patent is extended or adjusted under 35 U.S.C. 154(b) by 0 days.

(21) Appl. No.: 10/926,525

(22) Filed: Aug. 26, 2004

(65) Prior Publication Data

US 2005/0110417 A1 May 26, 2005

(30) Foreign Application Priority Data

Nov. 25, 2003 (CN) ..... 2003201151059

(51) Int. Cl.
*H05B 37/02* (2006.01)
*F21L 19/00* (2006.01)
*F23D 13/20* (2006.01)

(52) U.S. Cl. ..... 315/149; 362/161; 341/253

(58) Field of Classification Search ..... 315/149–159; 362/565, 161, 810

See application file for complete search history.

(56) References Cited

U.S. PATENT DOCUMENTS

| | | | | | |
|---|---|---|---|---|---|
| 3,761,702 | A | | 9/1973 | Andeweg | 240/2 R |
| 3,762,857 | A | | 10/1973 | Andeweg | 431/253 |
| 3,890,085 | A | | 6/1975 | Andeweg | 431/125 |
| 3,958,917 | A | | 5/1976 | Naz | 431/289 |
| 4,477,249 | A | * | 10/1984 | Ruzek et al. | 431/253 |
| 4,568,269 | A | | 2/1986 | Lin | 431/253 |
| 4,804,323 | A | | 2/1989 | Kim | 431/253 |
| 5,057,005 | A | | 10/1991 | Kwok | 431/253 |
| 6,033,209 | A | * | 3/2000 | Shin et al. | 431/253 |
| 6,050,812 | A | * | 4/2000 | Chuang | 431/253 |
| 6,074,199 | A | | 6/2000 | Song | 431/253 |
| 6,241,362 | B1 | * | 6/2001 | Morrison | 362/231 |
| 6,305,108 | B1 | | 10/2001 | Lin | 40/406 |
| 6,468,071 | B1 | * | 10/2002 | Zou | 431/290 |
| 6,488,494 | B1 | | 12/2002 | Lee | 431/253 |
| 6,491,516 | B1 | | 12/2002 | Tal et al. | 431/253 |
| 6,520,770 | B1 | | 2/2003 | Zou | 431/290 |
| 2002/0018976 | A1 | * | 2/2002 | Zou | 431/290 |
| 2002/0093834 | A1 | * | 7/2002 | Yu et al. | 362/565 |
| 2002/0119413 | A1 | | 8/2002 | Cheng | 431/289 |
| 2003/0134246 | A1 | * | 7/2003 | Gray et al. | 431/289 |
| 2004/0048213 | A1 | * | 3/2004 | Byrd | 431/35 |
| 2004/0160764 | A1 | * | 8/2004 | Lee | 362/161 |
| 2004/0233681 | A1 | * | 11/2004 | Yao et al. | 362/565 |
| 2004/0252492 | A1 | * | 12/2004 | Peterson | 362/183 |
| 2004/0257798 | A1 | * | 12/2004 | Hart et al. | 362/96 |

* cited by examiner

*Primary Examiner*—Trinh Dinh
*Assistant Examiner*—Tung Le
(74) *Attorney, Agent, or Firm*—Levisohn, Berger & Langsam, LLP

(57) ABSTRACT

A candle with a decorative light element is provided. A light emitting device is disposed within the main body of the candle, and a sensor connected to the light emitting device detects the presence of a flame on the wick. When a flame is detected by the sensor, the light emitting device is activated. The portion of the candle from which the wick projects is preferably substantially opaque, and the portion of the candle in which the light emitting device is disposed is preferably at least partially light transmissible or translucent, so that the glow of the flame does not interfere with the glow of the light emitting device within the candle.

18 Claims, 2 Drawing Sheets

CANDLE WITH INTERNAL ILLUMINATION

RELATED APPLICATIONS

This application claims priority from Chinese Patent Application No. 2003-20115105.9 filed Nov. 25, 2003.

BACKGROUND

1. Field of the Invention

The invention relates to candles, and more specifically to decorative candles.

2. Description of the Related Art

A candle usually emits light by the burning of its wick, however its use as a primary lighting instrument has been reduced with the popularization of electric light. Therefore, the candle is currently used more frequently as decoration.

As a result of this trend, there have emerged a number of decorative and entertainment candle-related products, one example of which can be found in Chinese Patent No. 02233525.0. This patent teaches a candle-based product having a flashing function having a candle and a base tray. The candle is rooted on the base tray, and the tray includes an integrated circuit, power supply, and light emitting diode (LED). The integrated circuit and LED are fixed on the base tray. An aluminum wire/foil core is used as lighting circuit switch; while the switch is closed, the candle will flash. However, there must be a base tray, and the lighting circuit must also be fixed on the base tray. The base tray therefore limits the geometry and nature of the candle. Another drawback is that the aluminum core here is made from two small aluminum foil bars with a layer of insulating material between them set parallel with the wick. The insulating material is removed by the high temperature developed by the burning of the wick, and the aluminum foil bars will be connected and form a circuit. However, burned ash will remain (from the combustion of the insulating material and the melting of the aluminum), and this negatively affects the candle's ability to provide decoration and view. More importantly, after the candle is shut off, the two pieces of aluminum must be pulled apart manually as they remain fused together, and thus the circuit remains closed. Finally, as with ordinary candles, some kind of smoke can be formed during operation, especially if the wick burns all the way down to the LEDs.

An improvement to this design is disclosed in U.S. patent application Ser. No. 09/758,179, published Jul. 18, 2002 with Publication No. 2002/0093834 (now abandoned). This application discloses the use of an optical fiber to conduct light from a flame on the wick to a photosensor switch on the LED base. When a flame is present, the LED light show is activated, and when the flame is extinguished, the LEDs go out as well. This design and the one mentioned above suffer from a major deficiency. Since the wax of the candle is designed to be light transparent, light from the flame easily enters and permeates the wax, thereby washing out the light emanating from the LEDs in the base of the candle. The light show effect is thereby diminished by the very trigger mechanism that activates it (the flame), and the result is not very impressive.

SUMMARY OF THE INVENTION

The invention includes a candle with a decorative light element. A light emitting device is disposed within the main body of the candle, and a sensor connected to the light emitting device detects the presence of a flame on the wick.

When a flame is detected by the sensor, the light emitting device is activated. A portion of the candle is preferably substantially opaque, and another portion of the candle is preferably at least partially light transmissible or translucent. Preferably, the wick projects from the substantially opaque portion and the light emitting device is disposed within the at least partially light transmissible or translucent portion. In this way, the glow of the flame does not interfere with the glow of the light emitting device within the candle.

In one embodiment, a flame barrier is preferably provided to prevent the wick from burning all the way down to the light emitting device and causing a fire. Preferably, the light emitting device in the candle includes at least one LED, and more preferably includes multiple LEDs of different colors. The light emitting device may further include a control and/or logic circuit and/or timing circuit for governing a sequence of each of the LEDs respective illuminations. That is, each of the LEDs is illuminated for a predetermined period of time, and preferably, more than one of the LEDs of different colors is illuminated at the same time during at least a portion of the sequence so as to produce an appearance of a color of light different from any single color of any of the LEDs.

Preferably, the main body is provided with a recess, and the light emitting device is disposed in the recess and sealed therein with wax. In this way, the candle and its light emitting device are one integral unit and may be placed upon any base or holder as any ordinary candle, since nothing would be sticking out of the bottom or sides of the inventive candle.

Preferably, the candle includes a flame barrier disposed in the main body between at least one end of the wick and the light emitting device. In one embodiment, the flame barrier is a disk or similarly shaped structure. The wick either terminates on a surface of the barrier or passes through a hole in the barrier; in the latter event, the hole is too small to allow a flame to propagate therethrough. The sensor may include a light pipe which conducts light from the flame to a photodetector associated with the light emitting device; the light pipe conducts the light past the flame barrier, e.g., through a hole in the flame barrier, around the side of the flame barrier, or if the flame barrier is made from a light transmissible material (e.g., glass), straight through the flame barrier.

The inventive candle resolves the issues mentioned above; the candle is capable not only of lighting but also of providing a colorful flashing performance which is interesting and beautiful.

The inventive candle may be provided in a transparent container, such as a glass jar.

The effective benefits with the scheme mentioned above are as follows. First, because the electronic components are wholly disposed within the candle itself and not on a base tray or other such candle holder, the shape and overall configuration of the device is not restricted in any way, and many diverse products can be made in accordance with the invention. Also, and more importantly, since the wick projects from the substantially opaque portion of the candle, the light show in the substantially light-transmissible portion is not washed out by or interfered with by the light of the flame of the wick. Further, because the electronic light emitting device is directly controlled by candle light, there is no need for manual operation of the light emitting device. Also, the light pipe will disappear with the burning of the wick creating no ash residue that would spoil the decorative function of the candle. Moreover, it is also possible (although not required) to dispose the candle within a glass container which will introduce more attractiveness as more colorful light will be sent out, while at the same time containing the candle nicely. The use of the flame barrier prevents the light emitting device from catching fire; since the light emitting device is mostly made of plastic, avoiding its combustion is quite desirable.

DETAILED DESCRIPTION OF EMBODIMENTS OF THE INVENTION

Figure 2:
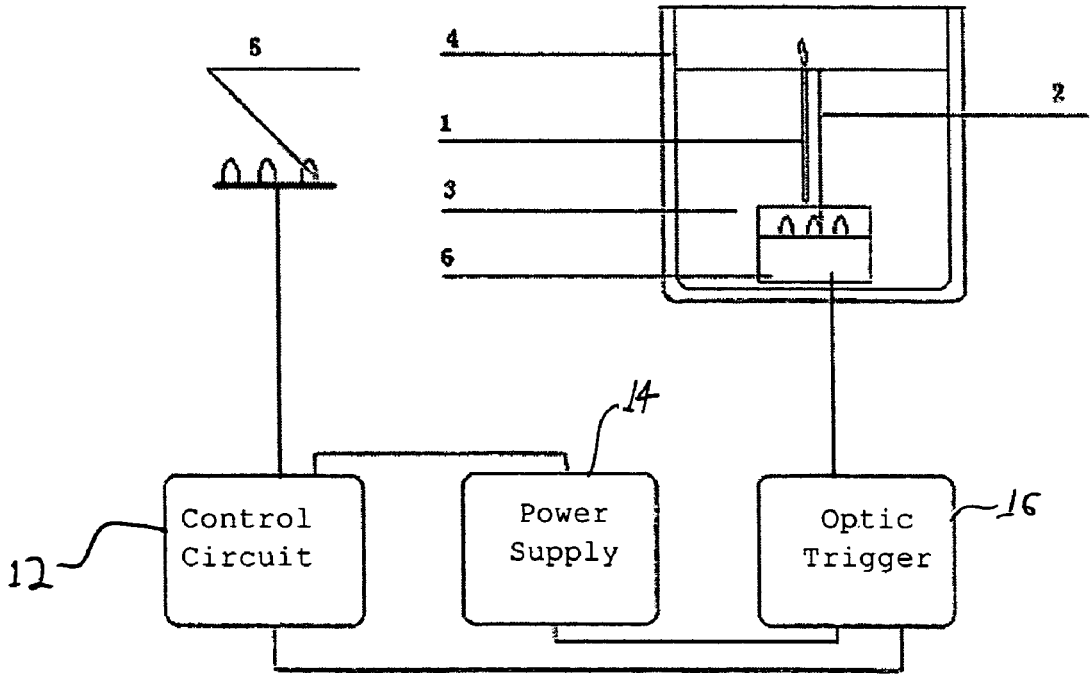
FIG. 2 is a schematic view of the candle of FIG. 1.
Figure 3:
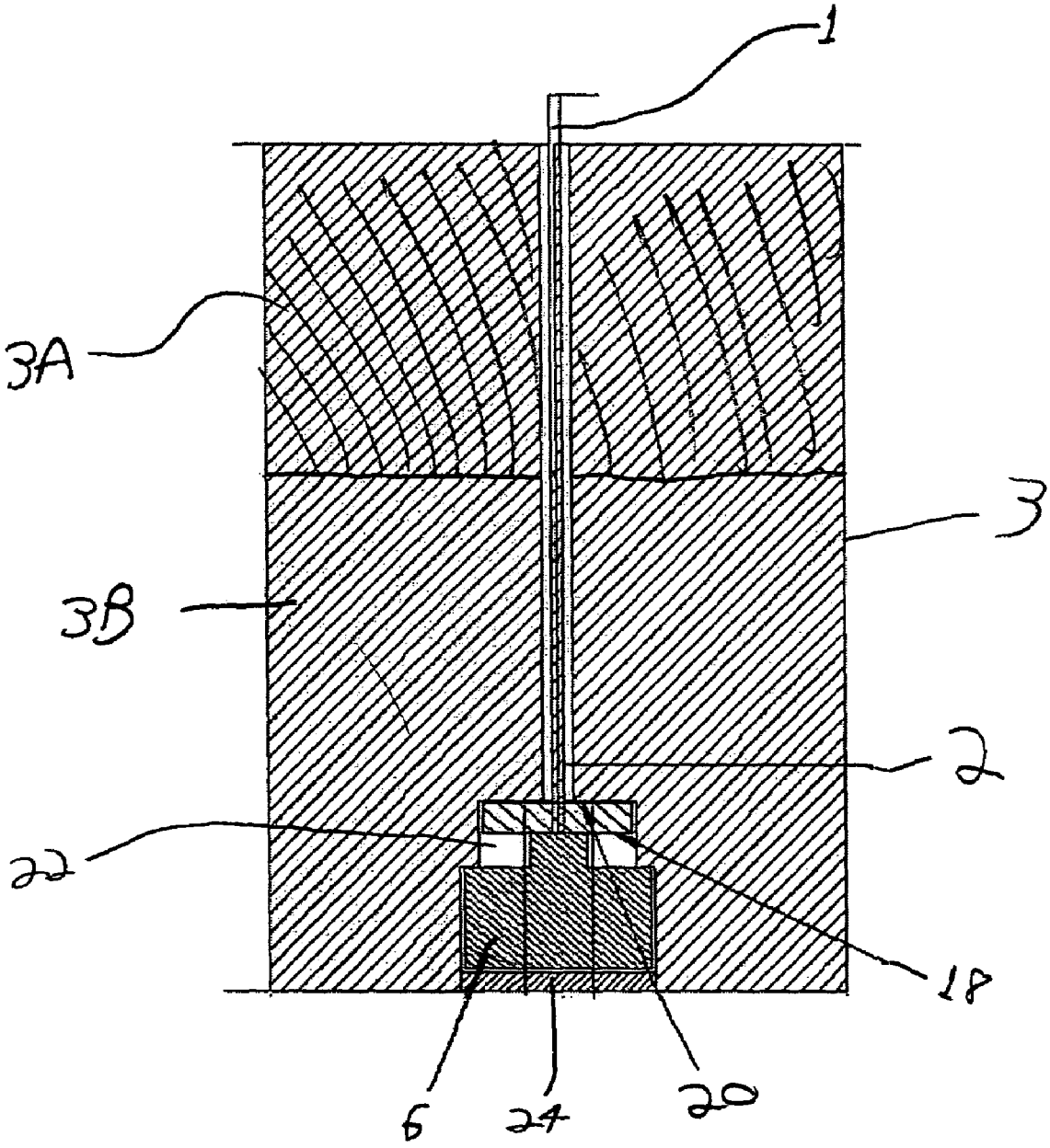
FIG. 3 is a sectional view of another embodiment of a candle in accordance with invention.

The invention will be now be described with reference to the attached FIGS. 1–3. It should be noted that these figures are exemplary in nature and in no way serve to limit the scope of the invention, which is defined by the claims appearing hereinbelow and their reasonable equivalents.

The basic components of the invention include candle body 3, and electronic light-emitting device 6, which is fixed inside candle body 3. Candle body 3 may be made from wax, paraffin, or any other material from which candles may be made or have been made.

Light pipe 2 is also disposed inside candle body 3 close to wick 1 (e.g., within a few millimeters). One end of the fiber is connected to electronic light-emitting device 6, which is composed of control circuit 12, power supply 14 (e.g., a battery), and LEDs 5. Power supply 14 is connected control circuit 12, which is also connected with LEDs 5 for governing the lighting sequence of the LEDs. Light-emitting device 6 also includes an optical trigger circuit 16 connected to control circuit 12 and power supply 14 for the purpose of switching on/off power supply 14. Optical trigger circuit 16 includes a photodetector such as a photosensitive switch set between control circuit and power supply, the light inlet of which is connected with light pipe 2. Trigger circuit 16 and/or control circuit 12 may be wholly or partially disposed on a computer chip.

Thus, when a flame is present on wick 1, the light emitted by the flame is conducted down light pipe 2 to the photodetector of optical trigger 16. When the photodetector detects such light, it activates power supply 14 and/or control circuit 12, and the light show begins. Light pipe 2 may be an optical fiber or any other material (typically plastic or a similar polymer) which conducts light. In a preferred embodiment, light pipe 2 is made from polystyrene and polymethylmethacrylate. Light pipe 2 might even be a hollow bore (and thus made of air) formed in candle body 3 which terminates at one end near wick 1 and at the other end near optical trigger circuit 16.

Figure 1:
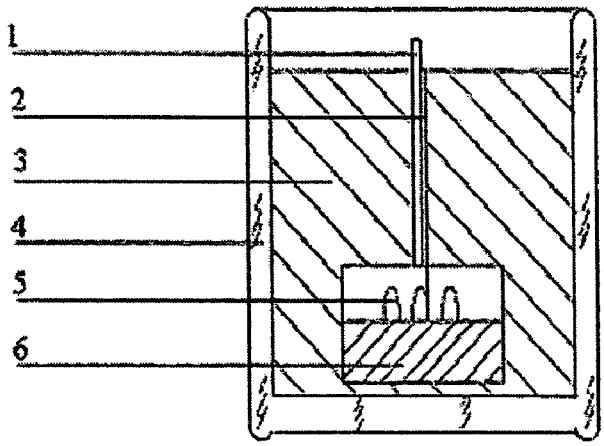
FIG. 1 is a sectional view of an embodiment of a candle in accordance with the invention.

As shown in FIG. 1, the light emitting device in the candle preferably includes at least one LED 5, and more preferably includes multiple LEDs of different colors. Each of LEDs 5 may be illuminated for a predetermined period of time, and preferably, more than one of the LEDs of different colors is illuminated at the same time during at least a portion of the sequence so as to produce an appearance of a color of light different from any single color of any of the LEDs. So, for example, a red LED and a blue LED may be illuminated simultaneously to create a purple glow. The sequence may include illuminating one LED, adding another LED gradually so that the color gradually changes to a combination of the two colors, and perhaps de-illuminating the first LED while maintaining the second LED's illumination. Many variations of this type of display are possible, especially given that more than two LEDs may be employed.

A basic embodiment of the invention is described above; a few preferred features are now described. First, the candle of the instant invention may be disposed in a translucent or transparent container such as glass jar 4 (see FIGS. 1 and 2). Second, the candle may be formed around the light emitting device 6, or as shown in FIG. 3, recess 22 may be provided in candle body 3 and light emitting device 6 may be disposed therein. A flame barrier 20 may be provided between wick 1 and light emitting device 6 so as to prevent the wick from burning down all the way to the light emitting device and causing it to catch fire; the light emitting device is likely made of plastic, and it would create a terrible smoke condition and/or a fire hazard were it to be ignited. Flame barrier 20, preferably a metal or glass disk or similar flameproof or flame retardant structure, may be spaced apart from light emitting device 6 with wax support 18. That is, flame barrier 20 is inserted into recess 22, then wax support 18 is inserted, then recess 22 is sealed with wax seal 24 to give the bottom of the candle a smooth, seamless appearance and configuration. Wick 1 may pass through flame barrier 20, or it preferably may terminate on a surface of flame barrier as shown in FIG. 3. Light pipe 2 may pass through flame barrier 20 as shown in FIG. 3, or it may pass around the side of flame barrier 20. The light pipe must conduct light from the flame directly or indirectly to the photosensor of light emitting device 6. In the event the flame barrier is made from glass or other flameproof or flame retardant but light transmissible material, the light pipe may terminate above the flame barrier and conduct light directly through the flame barrier.

Candle body 3 may be made from one color or type of wax. However, it is preferred that candle body 3 have two sections: substantially opaque section 3A and substantially translucent section 3B. It is preferred to dye the portion of the candle from which the wick 1 projects to be substantially opaque so that the light from the flame on the wick does not bleed into and thus interfere with the light generated by light emitting device 6. Conversely, it is preferred that the section in which the light emitting device 6 is disposed is as light-permeable as possible so that as much of the light from device 6 is visible.

The invention is not limited to the embodiments shown in the drawings. For example, the drawings depict a substantially cylindrical candle with a wick projecting from the top and the light emitting device disposed in the base. However, the wick may project from other surfaces of the candle, and the light emitting device may be disposed in other locations as well.

Having described the invention with respect to the above embodiments and drawings, it should be noted that the scope of the invention is not limited to the above description or what is shown in the drawings but rather is defined by the claims appearing hereinbelow and all such equivalents.

What is claimed is:

1. A candle, comprising:

a main candle body having a first substantially opaque section and a second at least partially translucent section;

a wick disposed in said main candle body and projecting from said first section;

a light emitting device disposed in said main candle body in said second section; and a sensor connected to said light emitting device detecting the presence of a flame on said wick, wherein when a flame is detected by said sensor, said light emitting device is activated, and wherein light emitted from said light emitting device is at least partially visible through said second section but light from a flame on said wick is substantially not transmitted through said first section of said main body.

2. A candle according to claim 1, wherein said light emitting device comprises at least one light emitting diode (LED).

3. A candle according to claim 2, wherein said light emitting device comprises multiple LEDs.

4. A candle according to claim 3, wherein each of said multiple LEDs arc a different color.

5. A candle according to claim 2, said light emitting device further comprising a control circuit.

6. A candle according to claim 5, wherein a sequence of each of said LEDs illumination is governed by said control circuit.

7. A candle according to claim 6, wherein said control circuit illuminates each of said LEDs for a predetermined period of time.

8. A candle according to claim 7, wherein said timing circuit illuminates more than one of said LEDs of different colors at the same time during at least a portion of said sequence so as to produce an appearance of a color of light different from any single color of any of said LEDs.

9. A candle according to claim 1, further comprising a flame barrier disposed in said main body between at least a portion of said wick and said light emitting device.

10. A candle according to claim 1, wherein said sensor comprises a light pipe disposed substantially near said wick and terminating at or near said light emitting device; and a photodetector coupled to said light emitting device, wherein said light pipe conducts light from a flame on said wick to said photodetector.

11. A candle according to claim 10, wherein said light pipe is disposed close enough to said wick so that the burning down of said wick by a flame substantially consumes said light pipe as well.

12. A candle according to claim 5, wherein said control circuit comprises software on a computer chip.

13. A candle, comprising:

a main body, said main body having a recess;

a wick disposed in and projecting from said main body;

a light emitting device disposed within said main body;

a flame barrier, made from a flameproof or flame retardant material, disposed in said main body between at least one end of said wick and said light emitting device, said light emitting device and said flame barrier being disposed in said recess and sealed therein with wax; and a sensor connected to said light emitting device detecting the presence of a flame on said wick, wherein when a flame is detected by said sensor, said light emitting device is activated.

14. A candle according to claim 13, wherein said wick terminates on a surface of said flame barrier.

15. A candle according to claim 13, further comprising a light pipe disposed substantially near said wick and terminating at or near said light emitting device, wherein said light pipe conducts light past said flame barrier.

16. A candle according to claim 15, further comprising a photodetector coupled to said light emitting device, wherein said light pipe conducts light from a flame on said wick to said photodetector.

17. A candle according to claim 16, said flame barrier being transparent and said light pipe terminating above said flame barrier and conducting light through said flame barrier to said photodetector.

18. A candle, comprising:

a main body;

a wick disposed in and projecting from said main body;

a light emitting device disposed within said main body;

a photodetector coupled to said light emitting device;

a flame barrier, made from a flameproof or flame retardant material, disposed in said main body between at least one end of said wick and said light emitting device, said flame barrier being transparent;

said light pipe terminating above said flame barrier and conducting light through said flame barrier to said photodetector, wherein when a flame is detected by said photodetector, said light emitting device is activated.

* * * * *